US006724345B2

(12) United States Patent
Tran

(10) Patent No.: US 6,724,345 B2
(45) Date of Patent: Apr. 20, 2004

(54) ANTENNA WITH PERIODIC ELECTROMAGNETIC MODE SUPPRESSION STRUCTURES AND METHOD FOR SAME

(75) Inventor: Allen Tran, San Diego, CA (US)

(73) Assignee: Kyocera Wirless Corp., San Diego, CA (US)

( * ) Notice: Subject to any disclaimer, the term of this patent is extended or adjusted under 35 U.S.C. 154(b) by 0 days.

(21) Appl. No.: 10/128,764

(22) Filed: Apr. 22, 2002

(65) Prior Publication Data

US 2003/0197646 A1 Oct. 23, 2003

(51) Int. Cl.[7] ..... H01Q 1/36
(52) U.S. Cl. ..... 343/700 MS; 343/846
(58) Field of Search ..... 343/700 MS, 846, 343/767, 770, 895, 909, 910

(56) References Cited

U.S. PATENT DOCUMENTS 5,977,924 A * 11/1999 Takei et al. ..... 343/770
6,040,803 A * 3/2000 Spall ..... 343/700 MS
6,075,485 A * 6/2000 Lilly et al. ..... 343/700 MS
6,191,750 B1 * 2/2001 Bonebright ..... 343/767

* cited by examiner

*Primary Examiner*—James Clinger

(57) ABSTRACT

A family of antennas, and a method for the same, are provided. The antennas include periodic electromagnetic structures to suppress non-radiating modes of propagation. Each antenna comprises a radiator resonant at a first frequency. A first dielectric is proximate to the radiator. Typically, a counterpoise is formed to the radiator. The periodic electromagnetic structures propagate a radiating mode, and suppress the propagation of a non-radiating mode. The periodic electromagnetic structures can be formed in the radiator, the counterpoise (when the counterpoise is distinctly distinguishable from the radiator), or in the first dielectric. The electromagnetic structures are a pattern of volumetric dielectric blocks having a predetermined shape and a predetermined spacing between blocks. For example, the shapes can be cylindrical blocks having predetermined diameters, cross-shaped blocks having predetermined arm widths and arm lengths, rectangular blocks having predetermined lengths and widths, or semi-spherical blocks having predetermined diameters.

66 Claims, 10 Drawing Sheets

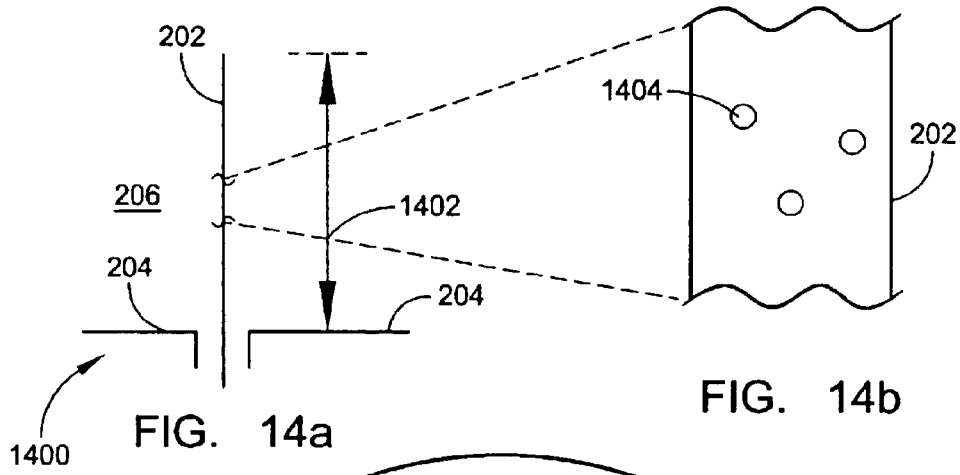
FIG. 14a
FIG. 14b
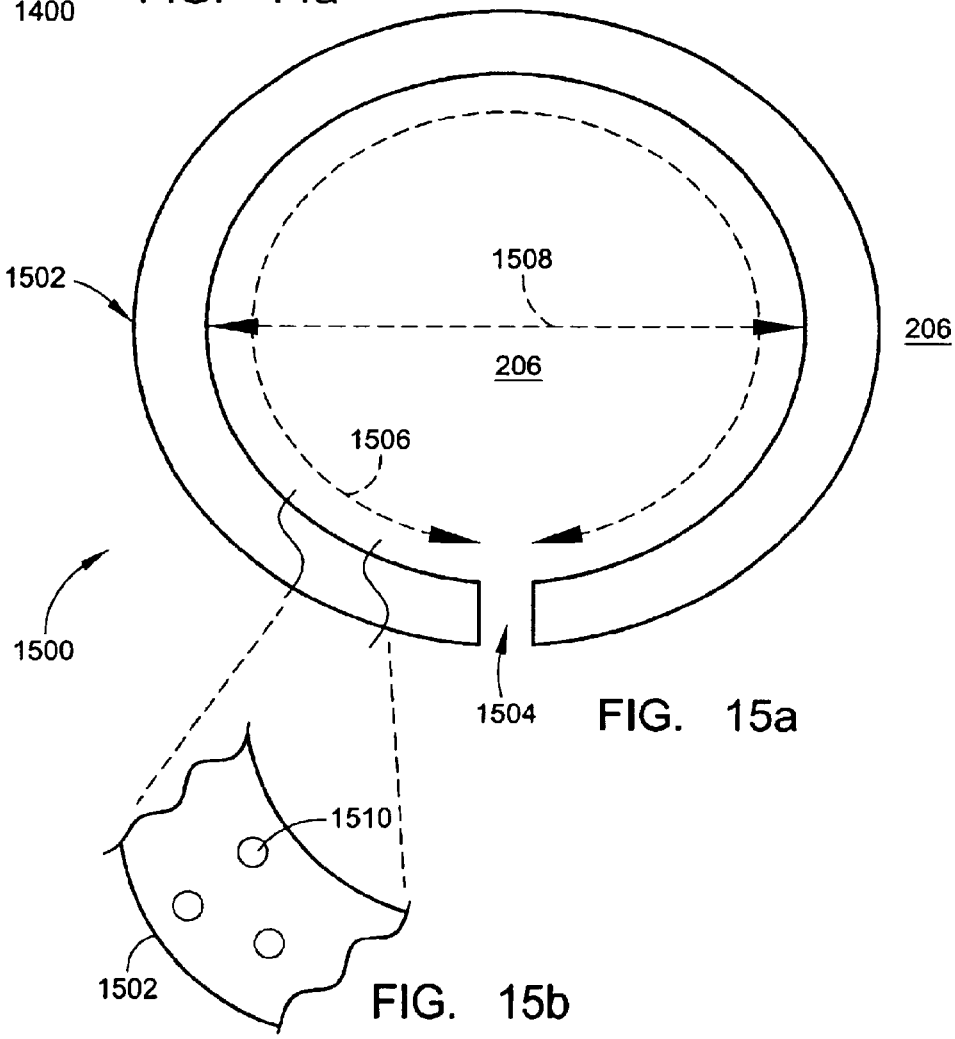
FIG. 15a
FIG. 15b

ANTENNA WITH PERIODIC ELECTROMAGNETIC MODE SUPPRESSION STRUCTURES AND METHOD FOR SAME

BACKGROUND OF THE INVENTION

1. Field of the Invention

This invention generally relates to antennas and, more particularly, to an antenna with periodic electromagnetic structures that suppress undesired propagation modes at the antenna's resonant frequency.

2. Description of the Related Art

A planar antenna comprises a dielectric, a groundplane (counterpoise), and a radiator. Current is induced from the radiator to the groundplane through the adjacent dielectric, and radiates electromagnetic wave energy into free space. Because of its small size and flat shape, the planar antenna occupies a small space. The planar antenna can be mass-produced and is commercially viable because of its cost and size.

FIG. 17 shows a microstrip patch antenna, which is a widely used type of planar antenna (prior art). The microstrip patch antenna 100 is comprised of dielectric 102, a conductor or groundplane 104 located adjacent the dielectric 102, and a microstrip line 106 for feeding the current to a radiator or radiating element 108. The microstrip line 106 can be connected to a wireless communications device, receiver, transmitter, or transmit/receive switch (not shown). The electrical characteristics of the antenna 100 are affected in general by the dimensions of its elements and in particular by the size of the radiating element 108 and its distance from the ground plane 104, and the dielectric constant of dielectric 102. The design of slot, waveguide, flare-notch, dipole, monopole, and loop antennas involve similar design criteria, as is well known in the art.

Several issues must be considered in the design of an antenna to maximize throughput to a communication partner. The antenna can be shaped to maximally receive or transmit for various radiation patterns. Likewise, the antennas can be made directional. Antennas are designed to generate space waves at the resonant frequency in an intended mode. However, due to perturbations of the standing wave in the transmission media, irregularities in the dielectric material, improper matching between the antenna and the transmission media, or irregularities in the fabrication of the antenna, so-called "leaky waves" are unintentionally generated that sap energy from the antenna operation in the intended radiation mode. Similar issues exist with the unintended creation of surface waves. Related problems involve the generation of evanescent waves, or non-propagated waves, when an antenna creates an unintended cutoff wavelength.

As is well understood in the art, an antenna acts to transform a guided wave in a transmission media, such as a coaxial cable or waveguide, into a space wave radiation mode propagated into a dielectric, such as air. When the phase velocity of the waves traveling in the transmission media is equal to the velocity of light (c), the transformation to the radiation mode space waves can be made without the loss of energy. Due to complex coupling between transverse electric (TE) and transverse magnetic (TM) modes in the transmission media, waves can be generated in the transmission media that have a phase velocity that is either greater than, or less than c. When the phase velocity exceeds c, leaky waves traveling in the transmission media are radiated, causing a continual energy loss. When the phase velocity is less than c, surface waves attenuate exponentially away from the transmission media surface, another loss of energy. It is an important to design antennas and antenna interfaces that mitigate the generation of leaky waves, surfaces waves, evanescent waves, and other forms of unintended radiation and wave propagation that rob power from the intended mode of radiation.

It would be advantageous if unintended modes of propagation associated with leaky waves, and the like, could be suppressed in an antenna.

It would be advantageous if a means existed of suppressing the unintended modes of propagation without changing the fundamentals of basic antenna design.

It would be advantageous if the unintended mode suppression means could be simply appended to conventional designs for patch, slot, waveguide, flare-notch, dipole, monopole, and loop antennas.

SUMMARY OF THE INVENTION

Wireless communications devices are expected to deliver high performance and great efficiency in a small package. Many wireless devices are expected to operate at a number of frequencies corresponding to the operation of the wireless device. Many wireless telephones can operate in the analog (AMPS), time division multiple access (TDMA), and code division multiple access (CDMA) modes. In addition, some wireless telephones incorporate global positioning system (GPS) receivers, and some incorporate local network transceivers for systems such as Bluetooth. It would improve the efficiency of wireless communications if antennas could be designed so that the unintended modes of propagation could be suppressed.

Accordingly, a family of antennas is provided with periodic electromagnetic structures to suppress unintended modes of propagation. Each antenna comprises a radiator resonant at a first frequency, with a proximate first dielectric and a counterpoise. The antenna conducts electromagnetic fields between the radiator and the counterpoise. A plurality of periodic electromagnetic structures propagate a radiating mode, while suppressing the propagation of a non-radiating mode. The periodic electromagnetic structures can be formed in the radiator, the counterpoise (when the counterpoise is distinctly distinguishable from the radiator), in the first dielectric, or in combinations of the above-mentioned elements.

The electromagnetic structures are a pattern of volumetric dielectric blocks having a predetermined shape and a predetermined spacing between blocks. For example, the shapes can be cylindrical blocks having predetermined diameters, cross-shaped blocks having predetermined arm widths and arm lengths, rectangular blocks having predetermined lengths and widths, or semi-spherical blocks having predetermined diameters. The blocks can be filled with a second dielectric with a second dielectric constant. Likewise, the volumetric blocks in either the radiator or counterpoise can be filled with the first dielectric material.

Using the above-described periodic electromagnetic structures, non-radiating modes can be suppressed in conventional patch, slot, waveguide, flare-notch, dipole, monopole, and loop antenna designs. Additional details of the above-mentioned antennas and a method for forming an antenna with periodic electromagnetic structures are described below.

BRIEF DESCRIPTION OF THE DRAWINGS

FIG. 14*a* is a plan view of the present invention monopole antenna, and FIG. 14*b* is a detailed view of the counterpoise.

FIG. 15*a* is a plan view of the present invention loop antenna, and FIG. 15*b* is a detailed view of the structure.

DETAILED DESCRIPTION OF THE PREFERRED EMBODIMENTS

The present invention describes an antenna with periodic electromagnetic structures to suppress non-radiating modes of propagation. As is well known, an antenna comprises a radiator resonant at a first frequency and a first dielectric, with a first dielectric constant, proximate to the radiator. Many antennas are also understood to include a counterpoise to the radiator, such as a ground. These components are common to all antennas, although the recitation of distinct radiator and counterpoise elements is not always applicable. Some antenna designs, such as a circular waveguide for example, have a virtual radiator and counterpoise to support the generation of standings waves at resonant frequencies, where the definition of a radiator or counterpoise is dependent upon the phase of the standing wave.

Regardless, the present invention further comprises a plurality of periodic electromagnetic structures that propagate a radiating mode at the resonant frequency. However, these periodic electromagnetic structures suppress the propagation of one or more non-radiating modes. These non-radiating modes are the leaky waves, surface waves, and the like, described in the Background section, above. The antenna style, first frequency, frequency bandwidth, and the non-radiating mode(s) to be suppressed are all factors that determine the geometries of the periodic electromagnetic structures.

Figure 1:
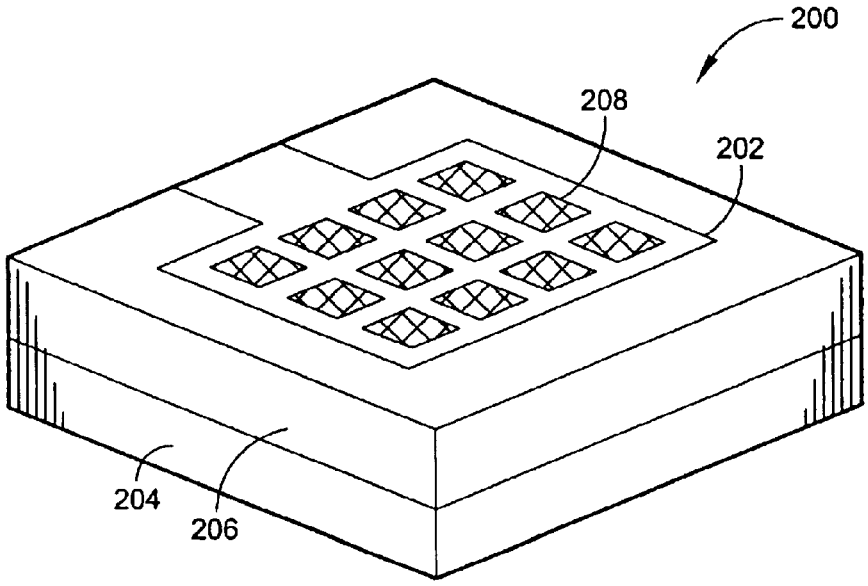
FIGS. 1 and 2 are perspective views of the present invention patch antenna.
Figure 2:
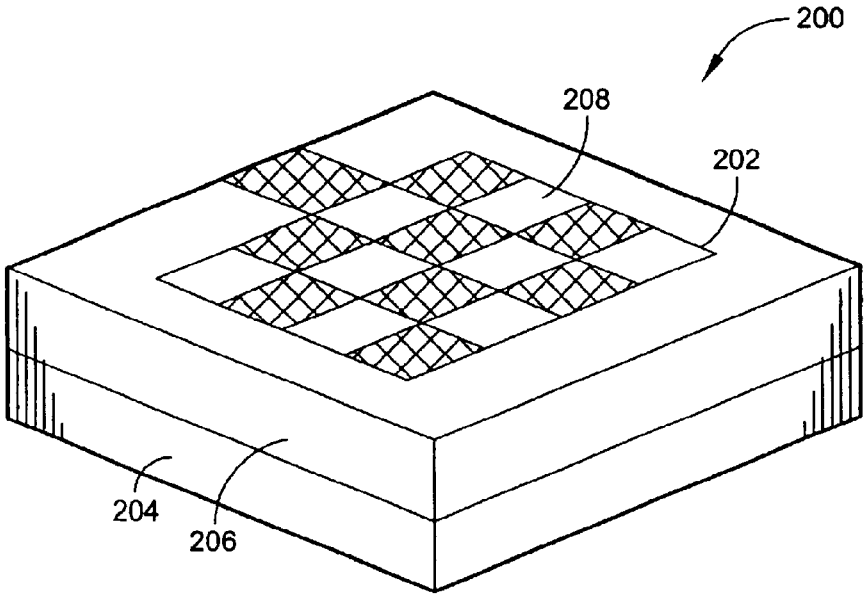

FIGS. 1 and 2 are perspective views of the present invention patch antenna. The patch antenna 200 comprises a radiator 202 in the form of a first conductive panel or patch. Typical conductive materials include aluminum, copper, copper alloys, and gold. The counterpoise 204 is a second conductive panel, typically parallel to the first panel 202. The first dielectric 206 is a layer interposed between the first 202 and second 204 parallel panels. Typical dielectric materials include air, FR4, foam, Aluminina, and TMM, to name but a few examples. The shape of the first panel, the dielectric constant of the first dielectric 206, and the thickness of the dielectric constant 206 are all variables in the design of the patch antenna 200. The principles of patch antenna design are well known to those practiced in the art and will not be repeated here in the interest of brevity. It should also be understood that a wide variety of patch antenna designs exist, that while differing in look from the antenna 200 in FIG. 2, share the same design principles.

FIGS. 1 and 2 represent two different versions of periodic electromagnetic structures formed in the radiator. In FIG. 1, periodic electromagnetic structures are shown (the cross-hatched areas), of which 208 is representative. The periodic electromagnetic structures 208 are a pattern of volumetric dielectric blocks in the radiator 202 having a predetermined shape and a predetermined spacing between blocks. In FIG. 2, the structures 208 are separated by conductor. In FIG. 2, the conductive areas are more loosely coupled. Note that the more loosely coupled conductor volumetric block structure would also be applicable to the counterpoise element 204, described below.

Figure 3:
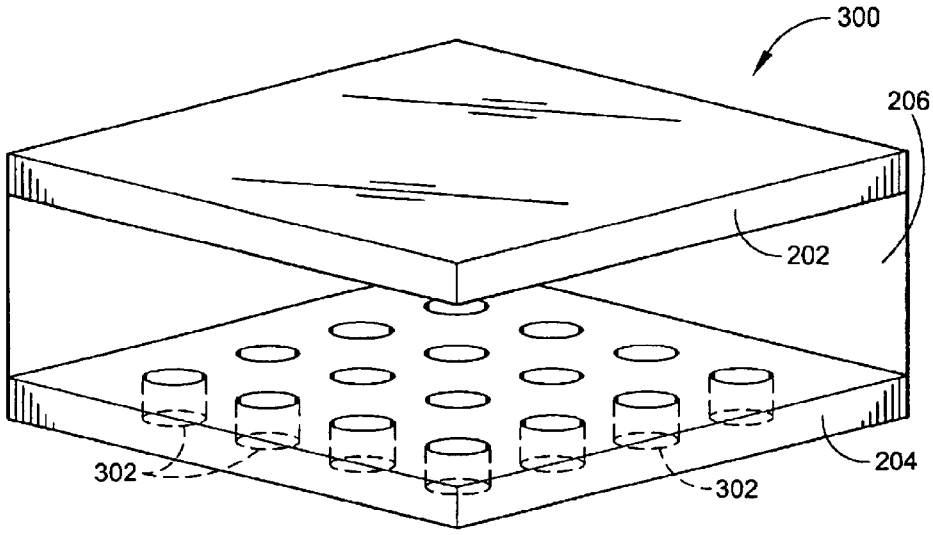
FIG. 3 is a perspective view of a patch antenna of the present invention with periodic electromagnetic structures formed in the counterpoise.

FIG. 3 is a perspective view of a patch antenna of the present invention with periodic electromagnetic structures 308 formed in the counterpoise 204.

Figure 4:
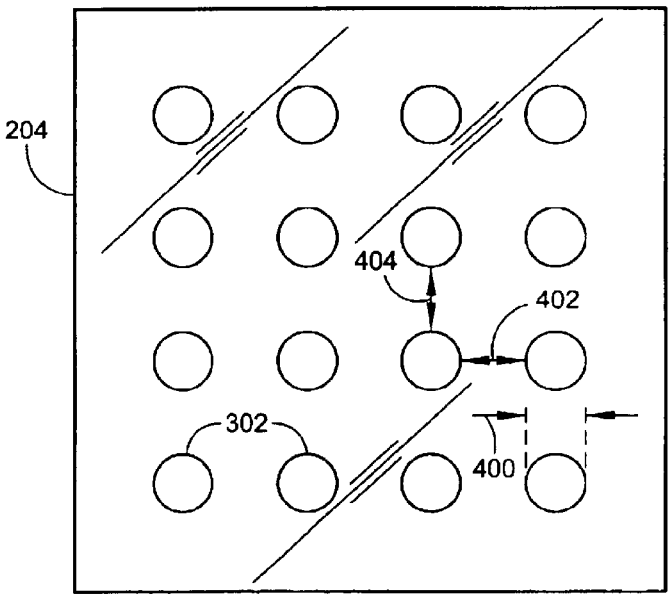
FIG. 4 is a plan view illustrating in greater detail the periodic electromagnetic structures of FIG. 3

FIG. 4 is a plan view illustrating in greater detail the periodic electromagnetic structures of FIG. 3. Although the discussion specifically describes the structures 302 formed in the counterpoise, the discussion also applies to the periodic electromagnetic structures formed in the radiator of FIGS. 1 and 2, and the periodic electromagnetic structures formed in the dielectric (presented below). As shown, the volumetric blocks are cylindrical blocks having predetermined diameters 400. The cylinders have a spacing between cylinders that is represented by reference designators 402 and 404.

Figure 5:
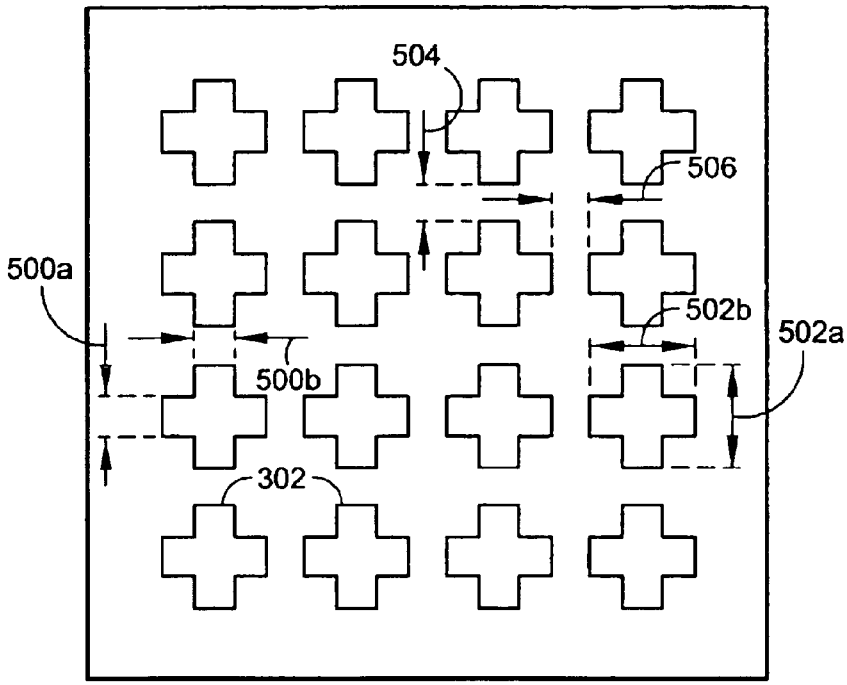
FIG. 5 is a plan view illustrating in greater detail an alternate aspect of the periodic electromagnetic structures of FIG. 3.

FIG. 5 is a plan view illustrating in greater detail an alternate aspect of the periodic electromagnetic structures of FIG. 3. Although the discussion specifically describes the structures 302 formed in the counterpoise, the discussion also applies to the periodic electromagnetic structures formed in the radiator of FIGS. 1 and 2, and the periodic electromagnetic structures formed in the dielectric (presented below). As shown, the volumetric blocks 302 are cross-shaped blocks having predetermined arm widths 500*a* and 500*b*, and arm lengths 502*a* and 502*b*. The spacing between blocks 302 is represented by reference designators 504 and 506.

Figure 6:
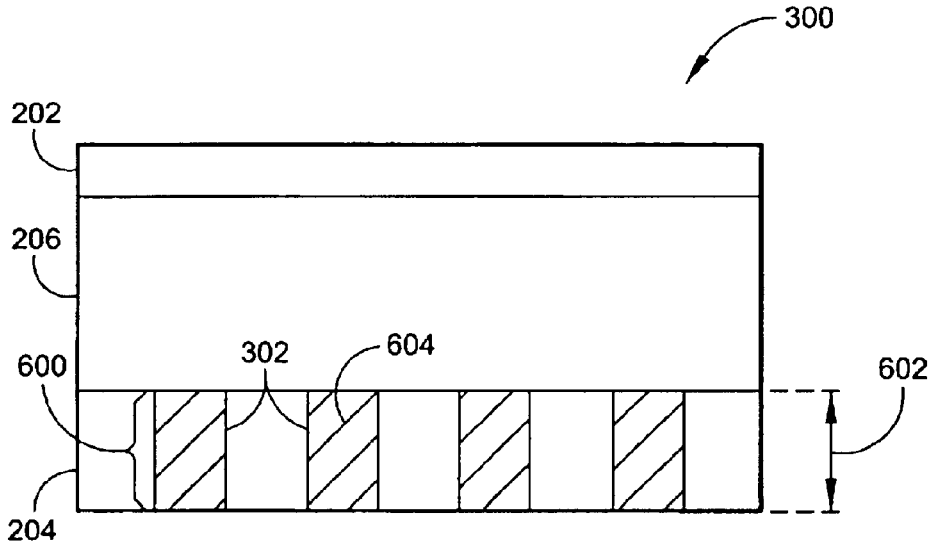
FIG. 6 is a partial cross-sectional view of the present invention patch antenna of FIG. 3.

FIG. 6 is a partial cross-sectional view of the present invention patch antenna of FIG. 3. In one aspect of the antenna, the blocks 302 (in whatever shape) have a length 600 that equals the thickness 602 of the counterpoise 204, as shown. Alternately but not shown, the blocks 302 can have a length 600 that is less than the counterpoise thickness 602. In yet another variation not shown, the blocks 302 can be formed in a plurality of lengths 600.

Figure 7:
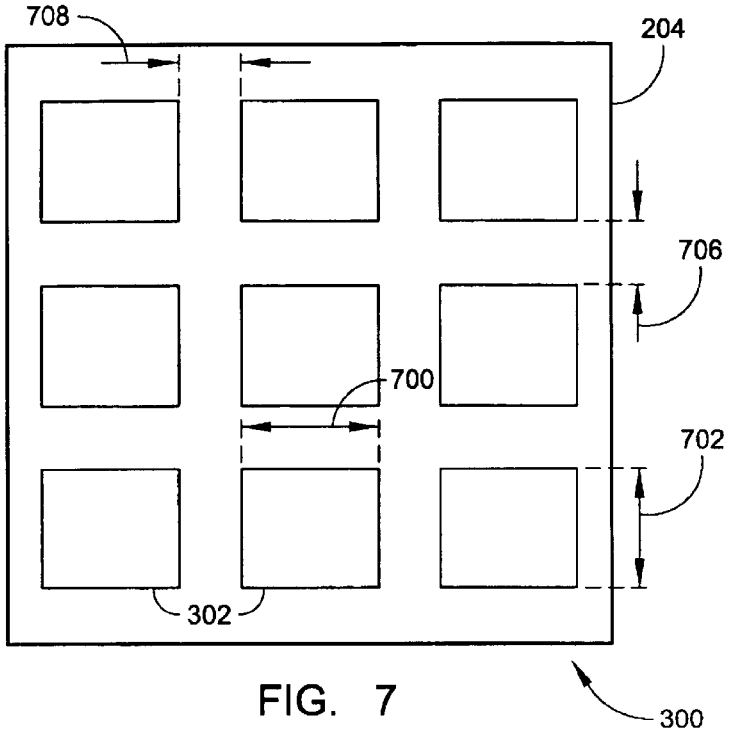
FIG. 7 is a plan view illustrating in greater detail an alternate aspect of the periodic electromagnetic structures of FIG. 3.

FIG. 7 is a plan view illustrating in greater detail an alternate aspect of the periodic electromagnetic structures of FIG. 3. Although the discussion specifically describes the structures 302 formed in the counterpoise, the discussion also applies to the periodic electromagnetic structures formed in the radiator of FIGS. 1 and 2, and the periodic electromagnetic structures formed in the dielectric (presented below). As shown, rectangular blocks 302 are formed each having a predetermined length 700 and width 702. The spacing between blocks 302 is represented by reference designators 704 and 706.

Returning momentarily to FIG. 6, in some aspects of the antenna, the volumetric blocks 302 are filled, or partially filled with a second dielectric 604, represented as cross-hatched area, with a second dielectric constant. In some aspects of the antenna, the second dielectric 604 is the same material as the first dielectric 206. Alternately, the second dielectric 604 is a different material, having a different dielectric constant than the first dielectric material. The second dielectric can also be either air or an electrical conductor, for example.

Once again, it should be understood that second dielectric can be used with any of the block shapes of FIGS. 4, 5, 7 or 8. Likewise, although the discussion specifically describes the structures 302 formed in the counterpoise, the discussion also applies to the periodic electromagnetic structures formed in the radiator of FIGS. 1 and 2, and the periodic electromagnetic structures formed in the dielectric (presented below).

Figure 8A:
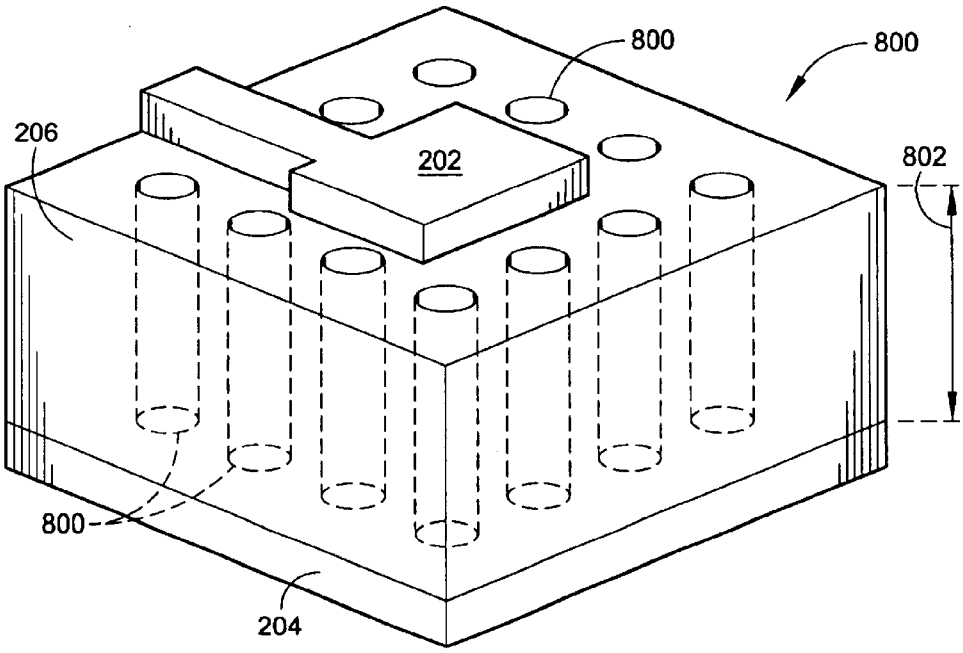
FIGS. 8*a* through 8*f* are perspective and cross-sectional views of alternate aspects of the present invention patch antenna.

FIGS. 8*a* through 8*f* are perspective and cross-sectional views of alternate aspects of the present invention patch antenna. FIG. 8*a* is a perspective view of the patch antenna 800 of the present invention where volumetric blocks 801 are formed in the first dielectric 206. As discussed above, the blocks 801 come in a plurality of shapes, although only cylindrical blocks are specifically shown. The discussion of block dimensions in FIGS. 4, 5, 6, and 7 also applies to the blocks 801 of FIG. 8. As in the discussion of FIG. 6, the volumetric blocks 801 formed in the first dielectric 206 need not have a length equal to the dielectric thickness 802, as is shown. Likewise as discussed above, the blocks 801 can be filled, or partially filled with a second dielectric, different than the first dielectric 206.

Figure 8B:
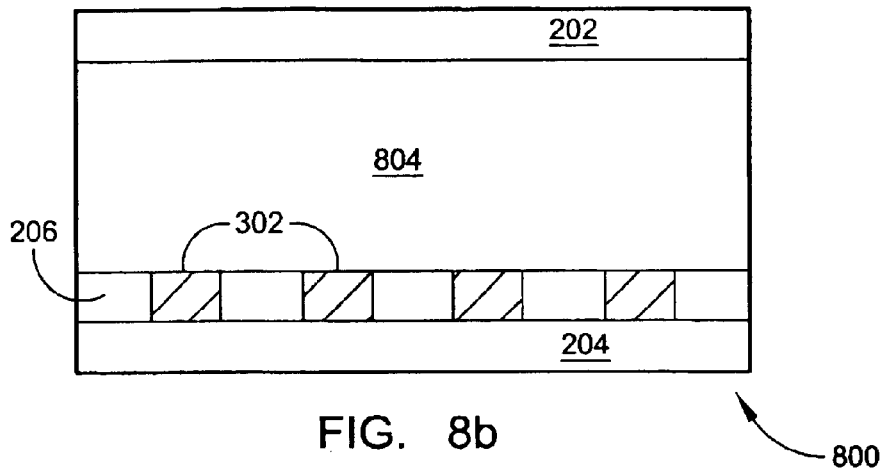

FIG. 8*b* is a cross-sectional view of an alternate aspect of the present invention patch antenna 800. The antenna includes a layer of third dielectric 804. The third dielectric can be one of the above-mentioned dielectric materials, or it could be a foam material to offer a dielectric constant approximately equal to 1 (air). The antenna 800 is tuned using the combination of the first 206 and third 804 dielectric layers. In some aspects of the invention (not shown), the first dielectric 206 and the third dielectric 804 includes volumetric blocks 302.

Figure 8C:
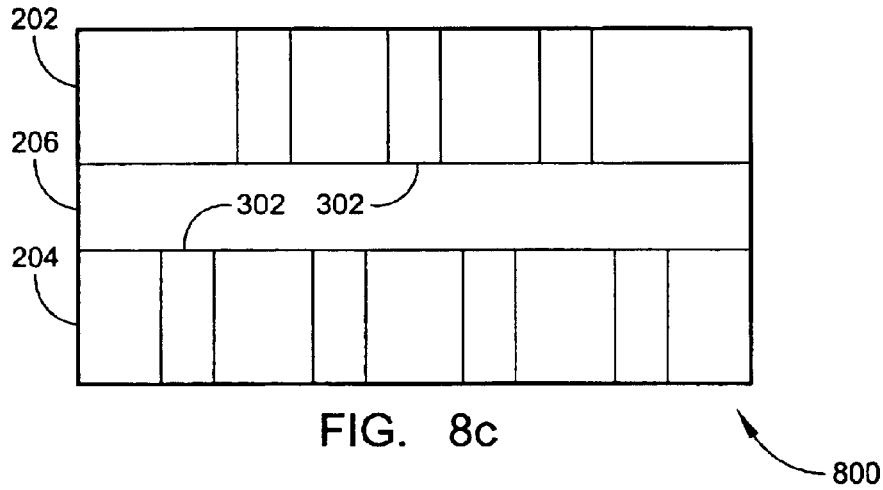

FIG. 8*c* is a cross-sectional view of an alternate aspect of the present invention patch antenna 800. As shown, volumetric blocks are formed in both the radiator 202 and the counterpoise 204. Although cylindrical blocks 302 are shown, the block shapes can be any of the shapes illustrated in FIGS. 3–7 (or FIG. 9 described below). Further the block shapes and patterns in the two elements 202/204 need not necessarily be the same. In some aspects, different patterns are used in the two elements to suppress different non-radiating modes.

Figure 8D:
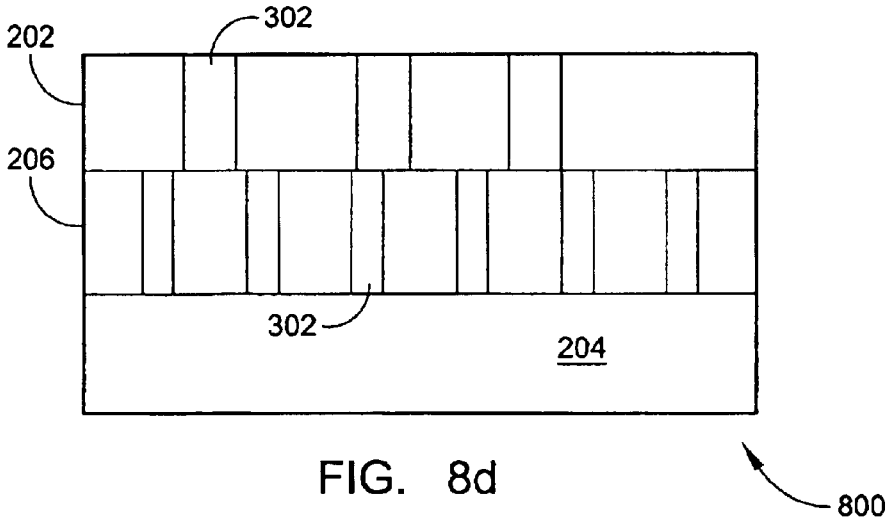

FIG. 8*d* is a cross-sectional view of an alternate aspect of the present invention patch antenna 800. As shown, volumetric blocks are formed in both the radiator 202 and the first dielectric 206. Although cylindrical blocks 302 are shown, the block shapes can be any of the shapes illustrated in FIGS. 3–7 (or FIG. 9 described below). Further the block shapes and patterns in the two elements 202/206 need not necessarily be the same. In some aspects, different patterns are used in the two elements to suppress different non-radiating modes.

Figure 8E:
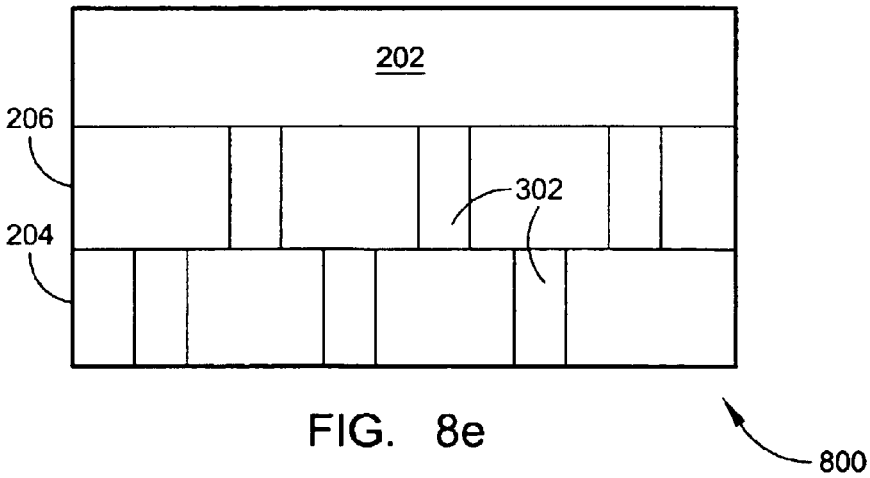

FIG. 8*e* is a cross-sectional view of an alternate aspect of the present invention patch antenna 800. As shown, volumetric blocks are formed in both the first dielectric 206 and the counterpoise 204. Although cylindrical blocks 302 are shown, the block shapes can be any of the shapes illustrated in FIGS. 3–7 (or FIG. 9 described below). Further the block shapes and patterns in the two elements 206/204 need not necessarily be the same. In some aspects, different patterns are used in the two elements to suppress different non-radiating modes.

Figure 8F:
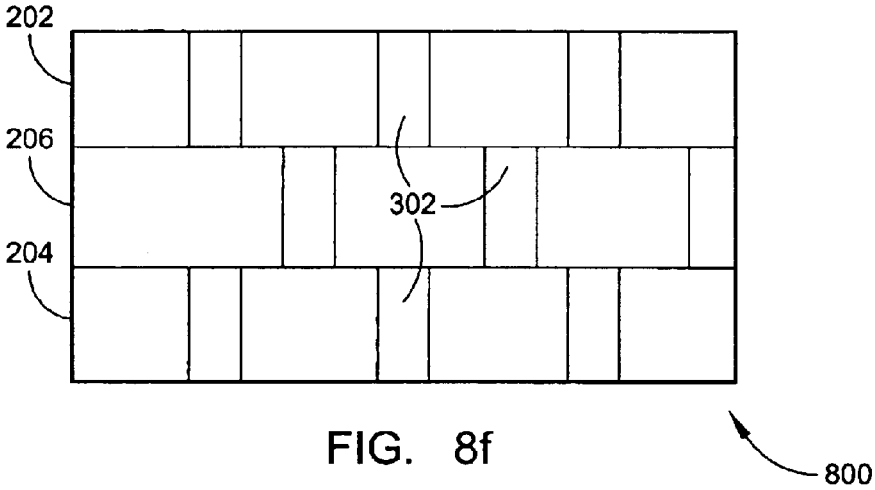

FIG. 8*f* is a cross-sectional view of an alternate aspect of the present invention patch antenna 800. As shown, volumetric blocks are formed in the radiator 202, the first dielectric 206, and the counterpoise 204. Although cylindrical blocks 302 are shown, the block shapes can be any of the shapes illustrated in FIGS. 3–7 (or FIG. 9 described below). Further the block shapes and patterns in the three elements 202/204/206 need not necessarily be the same. In some aspects, different patterns are used in the three elements to suppress different non-radiating modes. In another variations not shown, the third dielectric is included (see FIG. 8*b*). The third dielectric may, or may not include volumetric blocks.

Although not specifically shown, it should also be understood that the pattern of volumetric blocks in a single element, the first dielectric for example, may include more than one pattern of volumetric blocks, and more than one shape of volumetric blocks. In some aspects the different patterns suppress different non-radiating modes.

Figure 9:
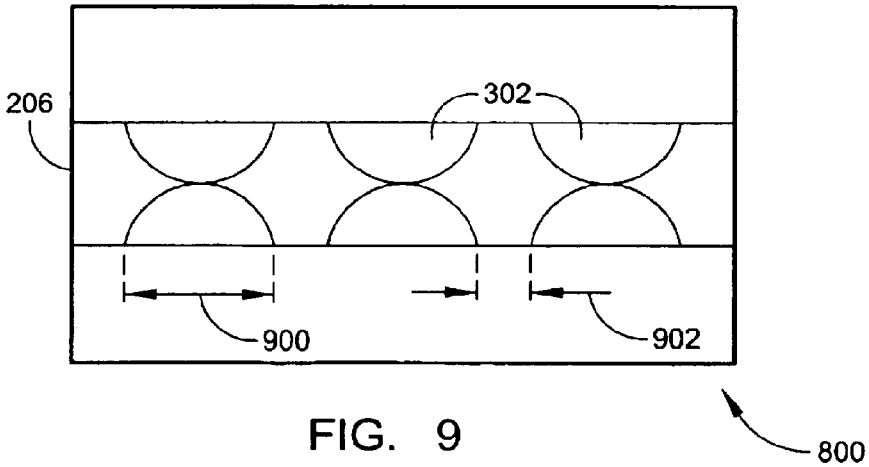
FIG. 9 is a cross-sectional view illustrating in greater detail an alternate aspect of the periodic electromagnetic structures of FIG. 8*a*.

FIG. 9 is a cross-sectional view illustrating in greater detail an alternate aspect of the periodic electromagnetic structures of FIG. 8*a*. Although the discussion specifically describes the structures 302 formed in the first dielectric 206, the discussion also applies to the periodic electromagnetic structures formed in the radiator of FIGS. 1 and 2, and the periodic electromagnetic structures formed in the counterpoise of FIGS. 3 through 7. As shown, semi-spherical blocks 302 are formed having predetermined diameters 900. The spacing between blocks 302 in a first coordinate direction is represented by reference designator 902. The spacing in the second coordinate system, into or out of the page, cannot be seen in the cross-section. Note, the semi-spherical blocks 302 need not necessarily touch other blocks as shown.

Figure 10A:
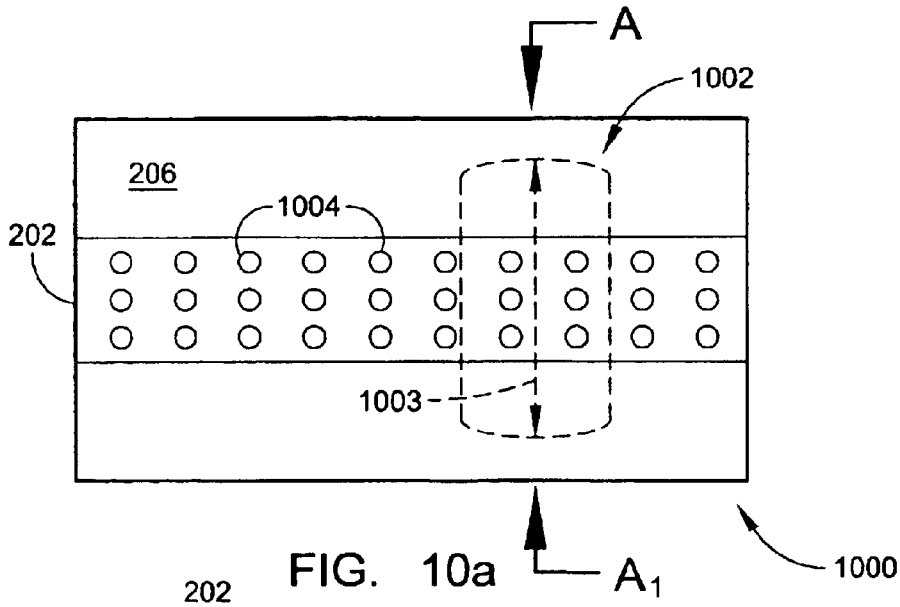
FIGS. 10*a* and 10*b* are a plan view and cross-sectional views, respectively, of a slot antenna where the radiator, first dielectric, and counterpoise are formed from a microstrip line.
Figure 10B:
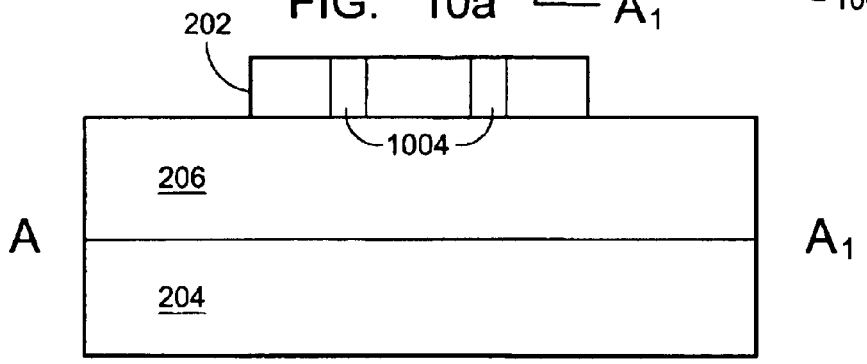

FIGS. 10*a* and 10*b* are a plan view and cross-sectional views, respectively, of a slot antenna 1000 where the radiator 202, first dielectric 206, and counterpoise 204 are formed from a microstrip line. The counterpoise 204 underlies the first dielectric 206. A slot 1002 (shown in dotted lines) is formed in the counterpoise. Although shown transverse to the radiator, the slot can be formed at other angles. Further, a plurality of slots, each at different angles to the radiator 202 can be formed in some aspects. As is well known, the slot 1002 has a length 1003 that is typically either one-half or one-quarter the wavelength of the first (resonant) frequency with respect to the first dielectric 206. Again, the principles of microstrip slot antennas are well known and are not repeated here in the interest of brevity.

As shown, cylindrical volumetric block structures 1004 are formed in the radiator 202. Alternately, the volumetric blocks can be any of the shapes described above in the explanation of FIGS. 4, 5, 6, 7, and 9 above, or any other shape. Further, although FIG. 10 illustrates the formation of volumetric blocks 1004 in the radiator 202, the volumetric blocks can alternately be formed in the first dielectric as shown in FIG. 8*a*, or formed in the counterpoise as shown in FIG. 3.

As with the patch antenna described above, the slot antenna can be formed with a third dielectric that may, or may not include volumetric blocks. Further, volumetric blocks can be formed in various combinations, or all three of the radiator, first dielectric, and counterpoise elements.

Figure 11:
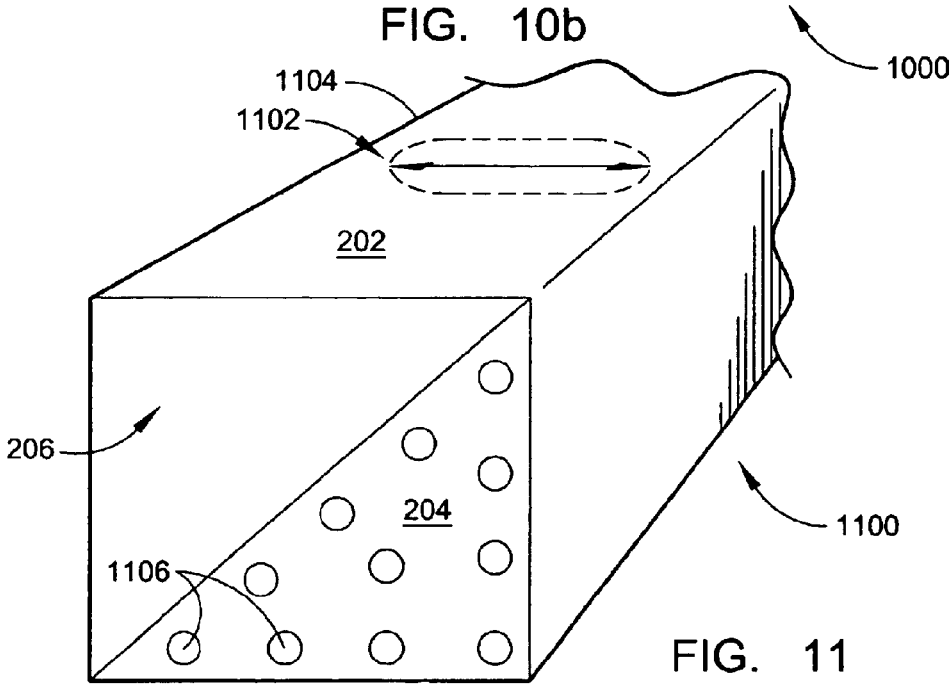
FIG. 11 is a perspective view of a radiator and counterpoise in the form of a waveguide antenna having an interior area that is filled by the first dielectric.

FIG. 11 is a perspective view of a radiator 202 and counterpoise 204 in the form of a waveguide antenna 1100 having an interior area that is filled by the first dielectric 206. A slot 1102 is formed in the waveguide 1100. Although shown transverse to the radiator, the slot can be formed at other angles. Further, a plurality of slots, each at different angles to the radiator 202 can be formed in some aspects. As shown, the slot 1102 is formed in the radiator 202. Alternately, the slot 1102 can be formed in the counterpoise 204. The recitation of a radiator or counterpoise in a waveguide antenna is arbitrary.

As is well known, the slot 1102 has a length 1104 that is typically either one-half or one-quarter the wavelength of the first (resonant) frequency with respect to the first dielectric 206. Again, the principles of waveguide antennas are well known and are not repeated here in the interest of brevity. Although a rectangular waveguide antenna is shown, the same principles apply to a circular waveguide (not shown).

As shown, cylindrical volumetric block structures 1106 are formed in the counterpoise 204. Alternately, the volumetric blocks can be any of the shapes described above in the explanation of FIGS. 4, 5, 6, 7, and 9 above, or any other shape. Further, although FIG. 11 illustrates the formation of volumetric blocks 1106 in the counterpoise 204, the volumetric blocks can alternately be formed in the first dielectric as shown in FIG. 8*a*, or formed in the radiator as shown in FIGS. 1 and 2.

As with the patch antenna described above, the waveguide antenna can be formed with a third dielectric that may, or may not include volumetric blocks. Further, volumetric blocks can be formed in various combinations, or all three of the radiator, first dielectric, and counterpoise elements.

Figure 12A:
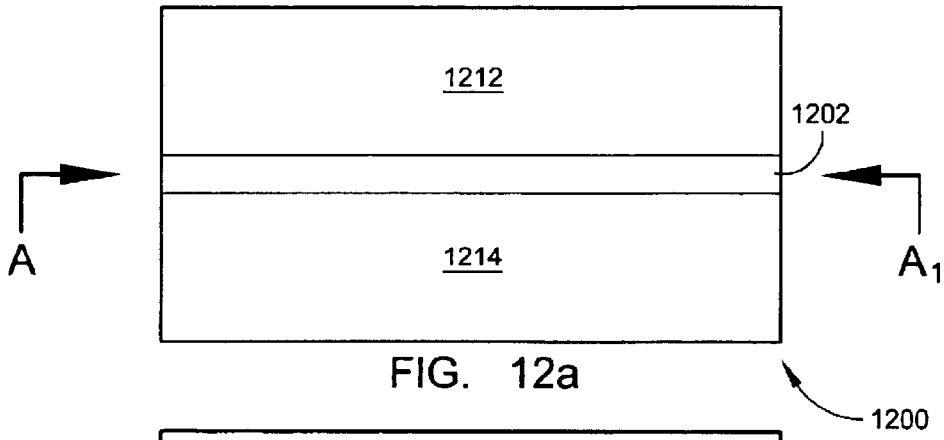
FIGS. 12*a* and 12*b* are plan and cross-sectional views, respectively, of the present invention flare-notch antenna.
Figure 12B:
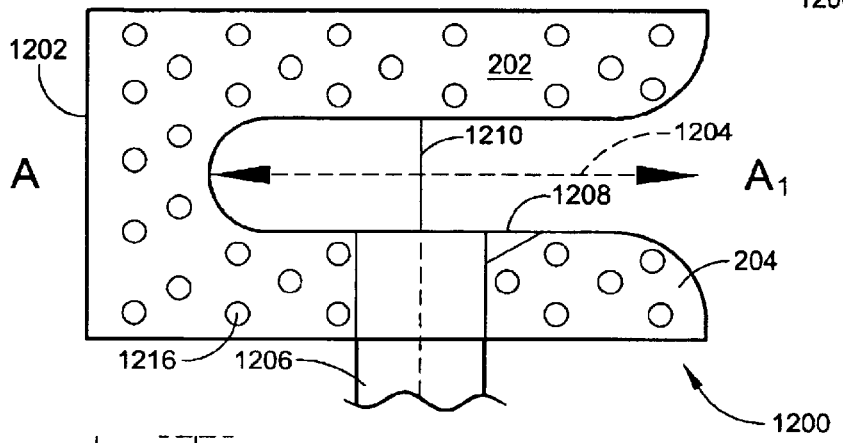

FIGS. 12*a* and 12*b* are plan and cross-sectional views, respectively, of the present invention flare-notch antenna 1200. As shown in FIG. 12*b*, the radiator 202 and counterpoise 204 form a flare-notch structure 1202 resonant at a first frequency. The notch length 1204 is typically one-quarter wavelength of the resonant frequency with respect to the first dielectric. A coax feed 1206 includes a counterpoise 1208 and a center conductor 1210. As shown in FIG. 12*a*, the first dielectric includes a first layer 1212 and a second layer 1214. The flare-notch structure 1202 is interposed between the first and second layers 1212/1214 of the first dielectric. The definition of radiator or counterpoise as used with a flare-notch antenna is arbitrary. Again, the principles of flare-notch antennas are well known and are not repeated here in the interest of brevity.

As shown, cylindrical volumetric block structures 1216 are formed in the radiator/counterpoise 202/204. Alternately, the volumetric blocks can be any of the shapes described above in the explanation of FIGS. 4, 5, 6, 7, and 9 above, or any other shape. Further, although FIG. 12*a* illustrates the formation of volumetric blocks 1210 in the radiator/counterpoise 202/204, the volumetric blocks can alternately be formed in the first dielectric as shown in FIG. 8*a*.

As with the patch antenna described above, the flare-notch antenna can be formed with a third dielectric, that may or may not include volumetric blocks. Alternately, the first and second dielectric layers 1212/1214 can have different dielectric constants. One or both the first and second layers 1212/1214 can include a section of third dielectric. Further, volumetric blocks can be formed in various combinations, or all three of the radiator, first dielectric, and counterpoise elements.

Figures 13A, 13B:
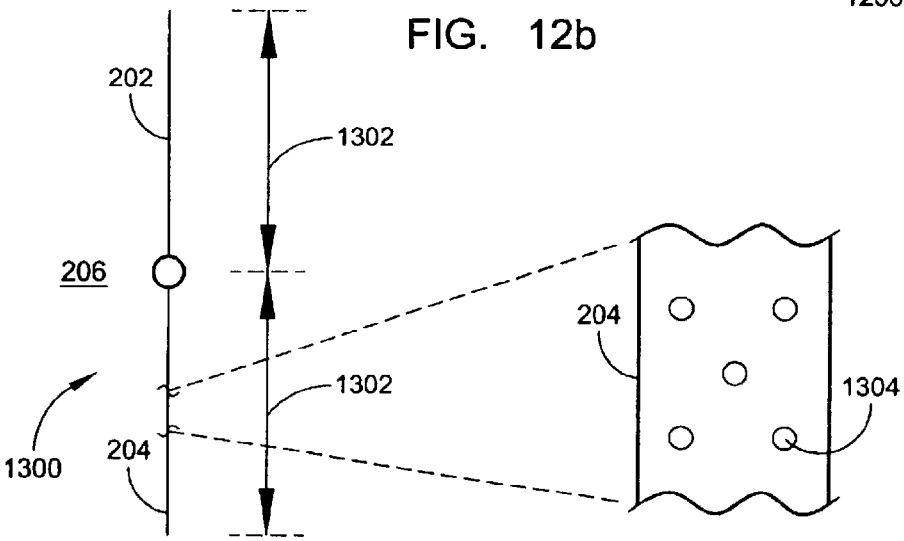
FIG. 13*a* is a plan view of the present invention dipole antenna.
FIG. 13*b* is a detailed view of the counterpoise.

FIG. 13*a* is a plan view of the present invention dipole antenna 1300, and FIG. 13*b* is a detailed view of the counterpoise 204. The radiator 202 and counterpoise 204 have matching lengths 1302 that are typically either one-half or one-quarter of the first frequency wavelength with respect to the first dielectric 206. The definition of radiator or counterpoise as used with a dipole antenna is arbitrary. Again, the principles of dipole antennas are well known and are not repeated here in the interest of brevity.

As shown in FIG. 13*b*, cylindrical volumetric block structures 1304 are formed in the counterpoise 204. Alternately, the volumetric blocks can be any of the shapes described above in the explanation of FIGS. 4, 5, 6, 7, and 9 above, or any other shape. Further, although FIG. 13*b* illustrates the formation of volumetric blocks 1304 in the counterpoise 204, the volumetric blocks can alternately be formed in the first dielectric as shown in FIG. 8*a*, or formed in the radiator as shown in FIGS. 1 and 2.

As with the patch antenna described above, the dipole antenna can be formed with a third dielectric that may, or may not include volumetric blocks. Further, volumetric blocks can be formed in various combinations, or all three of the radiator, first dielectric, and counterpoise elements.

FIG. 14*a* is a plan view of the present invention monopole antenna 1400, and FIG. 14*b* is a detailed view of the counterpoise 204. The radiator has a length 1402 that is typically either one-half or one-quarter of the first frequency wavelength with respect to the first dielectric 206. The principles of monopole antennas are well known and are not repeated here in the interest of brevity.

As shown in FIG. 14*b*, cylindrical volumetric block structures 1404 are formed in the radiator 202. Alternately, the volumetric blocks can be any of the shapes described above in the explanation of FIGS. 4, 5, 6, 7, and 9 above, or any other shape. Further, although FIG. 14*b* illustrates the formation of volumetric blocks 1404 in the radiator 202, the volumetric blocks can alternately be formed in the first dielectric as shown in FIG. 8*a*, or formed in the counterpoise as shown in FIG. 3.

As with the patch antenna described above, the monopole antenna can be formed with a third dielectric that may, or may not include volumetric blocks. Further, volumetric blocks can be formed in various combinations, or all three of the radiator, first dielectric, and counterpoise elements.

FIG. 15*a* is a plan view of the present invention loop antenna 1500, and FIG. 15*b* is a detailed view of the structure. The radiator forms a closed loop structure 1502 with a gap 1504. Again, the recitation of specific radiator or counterpoise section is arbitrary. The radiator structure 1502 has a length 1506 and a diameter 1508, that together with the gap 1504, that are manipulated to cause the antenna to resonant at the first frequency. Other shapes besides circular are well known. The principles of loop antennas are known, and are not repeated here in the interest of brevity.

As shown in FIG. 15*b*, cylindrical volumetric block structures 1510 are formed in the radiator structure 1502. Alternately, the volumetric blocks can be any of the shapes described above in the explanation of FIGS. 4, 5, 6, 7, and 9 above, or any other shape. Further, the volumetric blocks can alternately be formed in the first dielectric 206 as shown in FIG. 8*a*.

Figure 16:
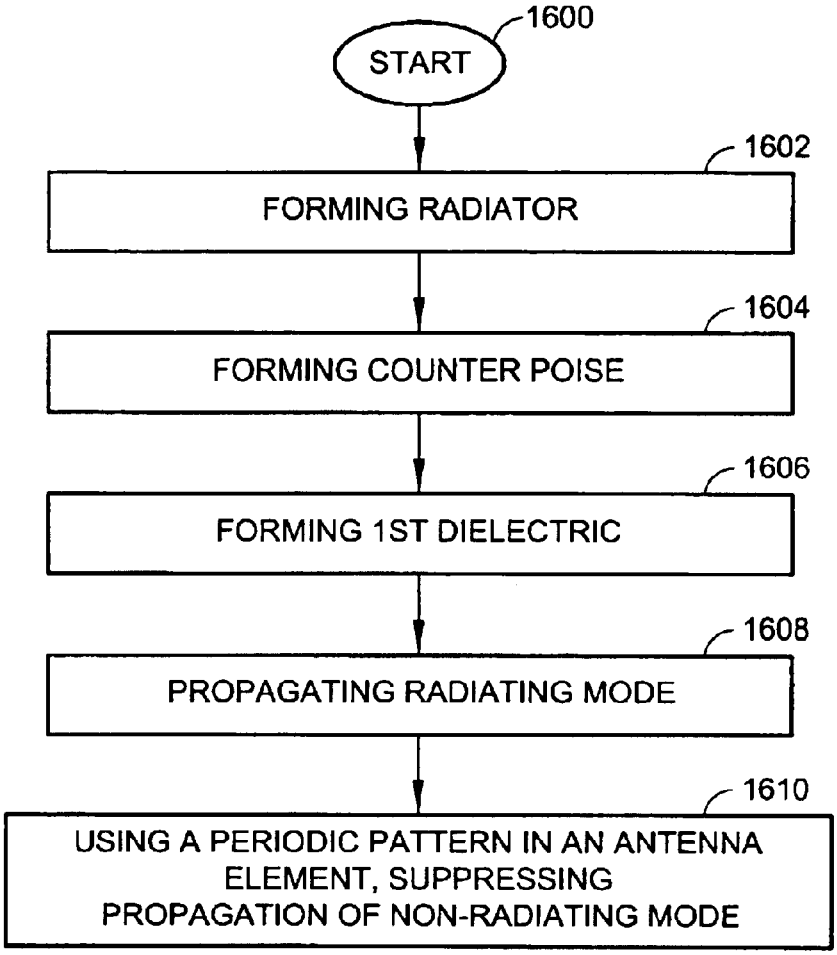
FIG. 16 is a flowchart illustrating a method for forming an antenna with periodic electromagnetic structures.
Figure 17:
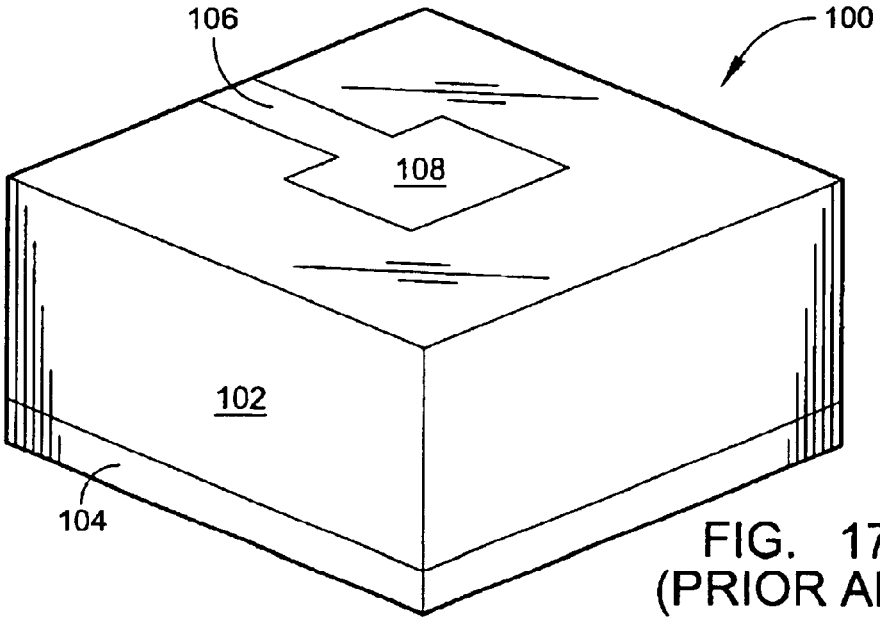
FIG. 17 (PRIOR ART)
FIG. 17 shows a micorstrip patch antenna, which is a widely used type of planar antenna (prior art).

FIG. 16 is a flowchart illustrating a method for forming an antenna with periodic electromagnetic structures. Although this method is depicted as a sequence of numbered steps for clarity, no order should be inferred from the numbering unless explicitly stated. It should be understood that some of these steps may be skipped, performed in parallel, or performed without the requirement of maintaining a strict order of sequence. The methods start at Step 1600. Step 1602 forms a radiator. Step 1606 forms a first dielectric, proximate to the radiator. Step 1608, at a first resonant frequency, propagates a radiating mode. Step 1610, using a predetermined periodic pattern in an antenna element, suppresses the propagation of a non-radiating mode at the first resonant frequency. As explained below, the antenna element can include the radiator, the dielectric, and the counterpoise.

In some aspects of the method, forming a first dielectric in Step 1606 includes forming the first dielectric in a predetermined periodic pattern. Then, suppressing the propagation of the non-radiating mode in Step 1610 includes suppressing the propagation in response to the first dielectric periodic pattern. Forming the first dielectric in a periodic pattern includes forming a pattern of volumetric dielectric blocks in the first dielectric having a predetermined shape and a predetermined spacing between blocks. The volumetric blocks can be cylindrical blocks having predetermined diameters, cross-shaped blocks having predetermined arm widths and arm lengths, rectangular blocks having predetermined lengths and widths, or semi-spherical blocks having predetermined diameters.

In some aspects of the method, forming the first dielectric in a pattern of volumetric blocks in Step 1606 includes filling the blocks with a second dielectric, having a second dielectric constant. The second dielectric can be a material such as air, electrical conductors, or dielectric material having a dielectric constant different than the first dielectric constant.

Some aspects of the method include a further step. Step 1607 forms a third dielectric proximate to the first dielectric. In some aspects Step 1607 forms the third dielectric in a predetermined periodic pattern. Then, suppressing the propagation of the non-radiating mode in Step 1610 includes suppressing the propagation in response to the first and third dielectric periodic patterns.

In some aspects of the method, forming a radiator in Step 1602 includes forming the radiator in a predetermined periodic pattern. Then, suppressing the propagation of the non-radiating mode in Step 1610 includes suppressing the propagation in response to the radiator periodic pattern. Forming the radiator in a periodic pattern includes forming a pattern of volumetric dielectric blocks in the radiator having a predetermined shape and a predetermined spacing between blocks. The volumetric blocks can be cylindrical blocks having predetermined diameters, cross-shaped blocks having predetermined arm widths and arm lengths, rectangular blocks having predetermined lengths and widths, or semi-spherical blocks having predetermined diameters.

In some aspects of the method, forming the radiator in a pattern of volumetric blocks in Step 1602 includes filling the blocks with a second dielectric, having a second dielectric constant. The second dielectric can be the same as the first dielectric, either the same material or a material having the same dielectric constant. The second dielectric can be a material such as air, electrical conductors, or dielectric material having a dielectric constant different than the first dielectric constant.

As mentioned above, many antennas are understood to include a counterpoise. Then, a further step, Step 1604 forms a counterpoise to the radiator. Also as noted above, with some antenna styles, the designation of radiator and counterpoise can be arbitrary. In some aspects of the method, forming a counterpoise in Step 1604 includes forming the counterpoise in a predetermined periodic pattern. Then, suppressing the propagation of the non-radiating mode in Step 1610 includes suppressing the propagation in response to the counterpoise periodic pattern. Forming the counterpoise in a periodic pattern includes forming a pattern of volumetric dielectric blocks in the counterpoise having a predetermined shape and a predetermined spacing between blocks. The volumetric blocks can be cylindrical blocks having predetermined diameters, cross-shaped blocks having predetermined arm widths and arm lengths, rectangular blocks having predetermined lengths and widths, or semi-spherical blocks having predetermined diameters.

In some aspects of the method, forming the counterpoise in a pattern of volumetric blocks in Step 1604 includes filling the blocks with a second dielectric, having a second dielectric constant. The second dielectric can be the same as the first dielectric, either the same material or a material having the same dielectric constant. The second dielectric can be a material such as air, electrical conductors, or dielectric material having a dielectric constant different than the first dielectric constant.

In some aspects of the method, suppressing the propagation of the non-radiating mode in Step 1610 includes suppressing the propagation in response to a periodic pattern in both the radiator and the first dielectric. Alternately, Step 1610 includes suppressing the propagation of the non-radiating mode in response to periodic patterns in both the radiator and the counterpoise. As another alternative, Step 1610 includes suppressing the propagation of the non-radiating mode in response to periodic patterns in both the first dielectric and the counterpoise. As yet another alternative, Step 1610 includes suppressing the propagation of the non-radiating mode in response to periodic patterns in the radiator, the first dielectric, and the counterpoise.

A family of antennas fabricated with periodic electromagnetic mode suppression structures, and a method for using periodic electromagnetic structure to suppress a non-radiating mode in an antenna have been provided. A few examples of basic antenna types have been provided to explain how the volumetric blocks are implemented. However, the present invention is not limited to just these antenna types. Likewise, a few examples of volumetric block shapes and placements have been given. Again it should be understood that volumetric blocks shown are exemplary and the present invention concepts is more far reaching. Other variations and embodiments of the invention will occur to those skilled in the art.

We claim:

1. A method for forming an antenna with periodic electromagnetic structures, the method comprising:

forming a radiator;

forming a first dielectric, with a first dielectric constant, proximate to the radiator;

at a first resonant frequency, propagating a radiating mode; and, using a predetermined periodic pattern in an antenna element, suppressing the propagation of a non-radiating mode at the first resonant frequency.

2. The method of claim 1 wherein forming a first dielectric proximate to the radiator includes forming the first dielectric in a predetermined periodic pattern; and, wherein suppressing the propagation of the non-radiating mode includes suppressing in response to the first dielectric periodic pattern.

3. The method of claim 2 wherein forming the first dielectric in a periodic pattern includes forming a pattern of volumetric dielectric blocks in the first dielectric having a predetermined shape and a predetermined spacing between blocks.

4. The method of claim 3 wherein forming the first dielectric in a pattern of volumetric blocks includes forming blocks selected from the group including cylindrical blocks having predetermined diameters, cross-shaped blocks having predetermined arm widths and arm lengths, rectangular blocks having predetermined lengths and widths, and semi-spherical blocks having predetermined diameters.

5. The method of claim 4 wherein forming the first dielectric in a pattern of volumetric blocks includes filling the blocks with a second dielectric, having a second dielectric constant.

6. The method of claim 5 wherein forming the first dielectric in a pattern of volumetric blocks filled with a second dielectric includes selecting the second dielectric from the group including air, electrical conductors, and dielectric material having a second dielectric constant, different than the first dielectric constant.

7. The method of claim 2 further comprising:

forming a third dielectric proximate to the first dielectric.

8. The method of claim 7 wherein forming a third dielectric proximate to the first dielectric includes forming the third dielectric in a predetermined periodic pattern; and, wherein suppressing the propagation of the non-radiating mode includes suppressing in response to the first and third dielectric periodic patterns.

9. The method of claim 1 wherein forming a radiator includes forming the radiator in a predetermined periodic pattern; and, wherein suppressing the propagation of the non-radiating mode includes suppressing in response to the radiator periodic pattern.

10. The method of claim 9 wherein forming the radiator in a periodic pattern includes forming a pattern of volumetric dielectric blocks in the counterpoise having a predetermined shape and a predetermined spacing between blocks.

11. The method of claim 10 wherein forming the radiator in a pattern of volumetric blocks includes forming blocks selected from the group including cylindrical blocks having predetermined diameters, cross-shaped blocks having predetermined arm widths and arm lengths, rectangular blocks having predetermined lengths and widths, and semi-spherical blocks having predetermined diameters.

12. The method of claim 11 wherein forming the radiator in a pattern of volumetric blocks includes filling the blocks with a second dielectric, having a second dielectric constant.

13. The method of claim 12 wherein forming the radiator in a pattern of volumetric blocks filled with a second dielectric includes the second dielectric being the same as the first dielectric.

14. The method of claim 12 wherein forming the radiator in a pattern of volumetric blocks filled with a second dielectric includes selecting the second dielectric from the group including air, electrical conductors, and dielectric material having a second dielectric constant, different than the first dielectric constant.

15. The method of claim 1 further comprising:

forming a counterpoise to the radiator.

16. The method of claim 15 wherein forming a counterpoise includes forming the counterpoise in a predetermined periodic pattern; and, wherein suppressing the propagation of the non-radiating mode includes suppressing in response to the counterpoise periodic pattern.

17. The method of claim 16 wherein forming the counterpoise in a periodic pattern includes forming a pattern of volumetric dielectric blocks in the counterpoise having a predetermined shape and a predetermined spacing between blocks.

18. The method of claim 17 wherein forming the counterpoise in a pattern of volumetric blocks includes forming blocks selected from the group including cylindrical blocks having predetermined diameters, cross-shaped blocks having predetermined arm widths and arm lengths, rectangular blocks having predetermined lengths and widths, and semi-spherical blocks having predetermined diameters.

19. The method of claim 18 wherein forming the counterpoise in a pattern of volumetric blocks includes filling the blocks with a second dielectric, having a second dielectric constant.

20. The method of claim 19 wherein forming the counterpoise in a pattern of volumetric blocks filled with a second dielectric includes the second dielectric being the same as the first dielectric.

21. The method of claim 19 wherein forming the counterpoise in a pattern of volumetric blocks filled with a second dielectric includes selecting the second dielectric from the group including air, electrical conductors, and dielectric material having a second dielectric constant, different than the first dielectric constant.

22. The method of claim 1 further comprising:

forming a predetermined periodic pattern in an element selected from the group including the radiator and the first dielectric; and, wherein suppressing the propagation of the non-radiating mode includes suppressing in response to the periodic patterns in the selected elements.

23. The method of claim 22 wherein forming a predetermined periodic pattern in an element selected from the group including the radiator and the first dielectric includes forming a periodic pattern in both the radiator and the first dielectric; and, wherein suppressing the propagation of the non-radiating mode includes suppressing in response to the periodic patterns in the radiator and the first dielectric.

24. The method of claim 1 further comprising:

forming a counterpoise to the radiator;

forming a predetermined periodic pattern in an element selected from the group including the radiator and the counterpoise; and, wherein suppressing the propagation of the non-radiating mode includes suppressing in response to the periodic patterns in the selected elements.

25. The method of claim 24 wherein forming a predetermined periodic pattern in an element selected from the group including the radiator and the counterpoise includes forming a periodic pattern in both the radiator and the counterpoise; and, wherein suppressing the propagation of the non-radiating mode includes suppressing in response to the periodic patterns in both the radiator and the counterpoise.

26. The method of claim 1 further comprising:

forming a counterpoise to the radiator;

forming a predetermined periodic pattern in an element selected from the group including the first dielectric and the counterpoise; and, wherein suppressing the propagation of the non-radiating mode includes suppressing in response to the periodic patterns in the selected elements.

27. The method of claim 26 wherein forming a predetermined periodic pattern in an element selected from the group including the first dielectric and the counterpoise includes forming a periodic pattern in both the first dielectric and the counterpoise; and, wherein suppressing the propagation of the non-radiating mode includes suppressing in response to the periodic patterns in both the first dielectric and the counterpoise.

28. The method of claim 1 further comprising:

forming a counterpoise to the radiator;

forming a predetermined periodic pattern in an element selected from the group including the radiator, the first dielectric and the counterpoise; and, wherein suppressing the propagation of the non-radiating mode includes suppressing in response to the periodic patterns in the selected elements.

29. The method of claim 28 wherein forming a predetermined periodic pattern in an element selected from the group including the radiator, the first dielectric, and the counterpoise includes forming a periodic pattern in the radiator, the first dielectric, and the counterpoise; and, wherein suppressing the propagation of the non-radiating mode includes suppressing in response to the periodic patterns in the radiator, first dielectric, and the counterpoise.

30. An antenna with periodic electromagnetic structures, the antenna comprising:

a radiator resonant at a first frequency;

a first dielectric, with a first dielectric constant, proximate to the radiator; and, a plurality of periodic electromagnetic structures propagating a radiating mode, and suppressing the propagation of a non-radiating modes where the periodic electromagnetic structures are a pattern of volumetric dielectric blocks having a predetermined shape and a predetermined spacing between blocks.

31. The antenna of claim 30 wherein the periodic electromagnetic structures are formed in the first dielectric.

32. The antenna of claim 31 wherein first dielectric periodic electromagnetic structures are a pattern of volumetric dielectric blocks in the first dielectric having a predetermined shape and a predetermined spacing between blocks.

33. The antenna of claim 32 wherein first dielectric volumetric blocks are selected from the group including cylindrical blocks having predetermined diameters, cross-shaped blocks having predetermined arm widths and arm lengths, rectangular blocks having predetermined lengths and widths, and semi-spherical blocks having predetermined diameters.

34. The antenna of claim 33 further comprising:

a second dielectric with a second dielectric constant; and, wherein the first dielectric volumetric blocks are filled with the second dielectric.

35. The antenna of claim 34 wherein the second dielectric is selected from the group including air, electrical conductors, and dielectric material having a second dielectric constant, different than the first dielectric constant.

36. The antenna of claim 31 further comprising:

a third dielectric proximate to the first dielectric.

37. The antenna of claim 36 wherein the periodic electromagnetic structures are a pattern of volumetric dielectric blocks in the first and third dielectrics having a predetermined shape and a predetermined spacing between blocks.

38. The antenna of claim 30 wherein the periodic electromagnetic structures are formed in the radiator.

39. The antenna of claim 38 wherein radiator periodic electromagnetic structures are a pattern of volumetric dielectric blocks in the radiator having a predetermined shape and a predetermined spacing between blocks.

40. The antenna of claim 39 wherein radiator volumetric blocks are selected from the group including cylindrical blocks having predetermined diameters, cross-shaped blocks having predetermined arm widths and arm lengths, rectangular blocks having predetermined lengths and widths, and semi-spherical blocks having predetermined diameters.

41. The antenna of claim 40 further comprising:

a second dielectric with a second dielectric constant; and, wherein the radiator volumetric blocks are filled with the second dielectric.

42. The antenna of claim 41 wherein the second dielectric is the same as the first dielectric.

43. The antenna of claim 41 wherein the second dielectric is selected from the group including air, electrical conductors, and dielectric material having a second dielectric constant, different than the first dielectric constant.

44. The antenna of claim 30 further comprising:

a counterpoise to the radiator.

45. The antenna of claim 44 wherein the periodic electromagnetic structures are formed in the counterpoise.

46. The antenna of claim 45 wherein counterpoise periodic electromagnetic structures are a pattern of volumetric dielectric blocks in the counterpoise having a predetermined shape and a predetermined spacing between blocks.

47. The antenna of claim 46 wherein counterpoise volumetric blocks are selected from the group including cylindrical blocks having predetermined diameters, cross-shaped blocks having predetermined arm widths and arm lengths, rectangular blocks having predetermined lengths and widths, and semi-spherical blocks having predetermined diameters.

48. The antenna of claim 47 further comprising:

a second dielectric with a second dielectric constant; and, wherein the counterpoise volumetric blocks are filled with the second dielectric.

49. The antenna of claim 48 wherein the second dielectric is the same as the first dielectric.

50. The antenna of claim 48 wherein the second dielectric is selected from the group including air, electrical conductors, and dielectric material having a second dielectric constant, different than the first dielectric constant.

51. The antenna of claim 30 wherein the periodic electromagnetic structures are formed in an element selected from the group including the radiator and the first dielectric.

52. The antenna of claim 51 wherein periodic electromagnetic structures are formed in both the radiator and the first dielectric.

53. The antenna of claim 30 further comprising:

a counterpoise to the radiator;

wherein the periodic electromagnetic structures are formed in an element selected from the group including the radiator and the counterpoise.

54. The antenna of claim 53 wherein the periodic electromagnetic structures are formed in both the radiator and the counterpoise.

55. The antenna of claim 30 further comprising:

a counterpoise to the radiator;

wherein the periodic electromagnetic structures are formed in an element selected from the group including the first dielectric and the counterpoise.

56. The antenna of claim 55 wherein the periodic electromagnetic structures are formed in both the first dielectric and the counterpoise.

57. The antenna of claim 30 further comprising:

a counterpoise to the radiator;

wherein the periodic electromagnetic structures are formed in an element selected from the group including the radiator, the first dielectric, and the counterpoise.

58. The antenna of claim 57 wherein the periodic electromagnetic structures are formed in the radiator, the first dielectric, and the counterpoise.

59. The antenna of claim 57 in which the antenna is a patch;

wherein the radiator is a first conductive panel;

wherein the counterpoise is a second conductive panel, parallel to the first panel;

wherein the first dielectric is a layer interposed between the first and second parallel panels.

60. The antenna of claim 57 in which the antenna is a slot antenna further comprising;

a slot having a length selected from the group including one-half and one-quarter the wavelength of the first frequency with respect to the first dielectric.

61. The antenna of claim 60 wherein the radiator, first dielectric, and counterpoise form a microstrip line; and, wherein the slot is formed in the counterpoise.

62. The antenna of claim 60 wherein the radiator and counterpoise form a waveguide having an interior area;

wherein the first dielectric fills the waveguide interior area; and, wherein the slot is formed in the waveguide.

63. The antenna of claim 60 wherein the radiator and counterpoise form a flare-notch structure resonant at a first frequency;

wherein the first dielectric includes a first layer and a second layer; and, wherein the flare-notch structure is interposed between the first and second layers of the first dielectric.

64. The antenna of claim 57 in which the antenna is a dipole antenna; and, wherein the radiator and counterpoise have matching lengths selected from the group including one-half and one-quarter the first frequency wavelength with respect to the first dielectric.

65. The antenna of claim 57 in which the antenna is a monopole antenna; and, wherein the radiator has a length selected from the group including one-half and one-quarter the first frequency wavelength with respect to the first dielectric.

66. The antenna of claim 30 in which the antenna is a loop antenna; and, wherein the radiator forms a closed loop structure with a gap.

* * * * *

UNITED STATES PATENT AND TRADEMARK OFFICE

CERTIFICATE OF CORRECTION

PATENT NO. : 6,724,345 B2
DATED : April 20, 2004
INVENTOR(S) : Tran, Allen

It is certified that error appears in the above-identified patent and that said Letters Patent is hereby corrected as shown below:

Title page,
Item [73], should read:

-- [73] Assignee: Kyocera Wireless Corp. (San Diego, CA) --

Signed and Sealed this

Twenty-seventh Day of July, 2004

JON W. DUDAS
*Acting Director of the United States Patent and Trademark Office*